US005795071A

United States Patent [19]

Sasaki et al.

[11] Patent Number: 5,795,071

[45] Date of Patent: Aug. 18, 1998

[54] STANDING POUCH

[75] Inventors: Hitoshi Sasaki; Shoji Igota, both of Kawasaki, Japan

[73] Assignee: Ajinomoto Co., Inc., Tokyo, Japan

[21] Appl. No.: 914,755

[22] Filed: Aug. 20, 1997

Related U.S. Application Data

[63] Continuation of Ser. No. 653,702, May 23, 1996, abandoned, which is a continuation of Ser. No. 332,783, Nov. 1, 1994, abandoned.

[30] Foreign Application Priority Data

Jul. 20, 1994 [JP] Japan ..... 6-009899

[51] Int. Cl.[6] ..... B65D 30/10; B65D 30/16

[52] U.S. Cl. ..... 383/200; 383/104; 383/906

[58] Field of Search ..... 383/7, 9, 23, 104, 383/200, 202, 204, 207, 209, 906

[56] References Cited

U.S. PATENT DOCUMENTS

| | | | |
|---|---|---|---|
| 3,171,581 | 3/1965 | Kugler | 383/906 X |
| 4,974,732 | 12/1990 | Sullivan et al. | 383/906 X |
| 4,978,232 | 12/1990 | Dunton | 383/906 X |
| 5,005,734 | 4/1991 | Van Gordon et al. | 383/906 X |
| 5,018,646 | 5/1991 | Billman et al. | 383/906 X |
| 5,312,189 | 5/1994 | Aeschbach et al. | 383/906 X |

FOREIGN PATENT DOCUMENTS

| | | | |
|---|---|---|---|
| 0209739 | 1/1987 | European Pat. Off. | 383/200 |
| 2573391 | 5/1986 | France | 383/906 |
| 6127554 | 5/1994 | Japan | 383/906 |
| 406179461 | 6/1994 | Japan | 383/906 |
| 2278338 | 11/1994 | United Kingdom | 383/906 |

*Primary Examiner*—Jes F. Pascua

*Attorney, Agent, or Firm*—Oblon, Spivak, McClelland, Maier & Neustadt, P.C.

[57] ABSTRACT

A standing pouch having a recess formed on the upper part of a side of the body of the pouch and spaced from the upper side of the body, and a relief connecting with the inside of the pouch surrounded by an end of the upper side, the upper part of the side and the upper part of the recess and becoming a spout by removing the end portion of the relief. The standing pouch can ensure transfer of a fluid material contained therein to another container without the occurrence of overflow problem. The standing pouch permits the variation of the discharged amount to be small and less dripping occurs.

7 Claims, 3 Drawing Sheets

STANDING POUCH

This application is Continuation of application Ser. No. 08/653,702, filed on May 23, 1996, now abandoned which is a continuation of application Ser. No. 08/332,783, filed on Nov. 1, 1994, now abandoned.

BACKGROUND OF THE INVENTION

1. Field of the Invention

This invention relates to a standing pouch for containing a fluid material, such as powder or liquid, and more particularly, relates to a standing pouch provided with a relief capable of converting to a pourer (opening for pouring) at an upper corner portion.

2. Discussion of the Background

Standing pouches are usable as standable containers in spite of their simple package structure, and they are widely used as containers for containing a fluid material, such as powder or liquid.

Conventional standing pouches are composed of fundamentally three flexible sheets, i.e. a front sheet, a rear sheet and a bottom sheet. The front sheet and the rear sheet are symmetrical, and the bottoms of the front sheet and the rear sheet are straight or slightly spread in an arc. In the process of construction, in general, the bottom sheet is doubled, and the three sheets are superposed in the order of the rear sheet, the bottom sheet of which the folded portion is located upward, and the front sheet, and both sides and the bottom are heat-sealed to form two side seal portions and a bottom seal portion. The side seal portions are formed usually with a uniform width, but the bottom seal portion is formed in a horizontally symmetrical arc so as to gradually widened toward each side. When a fluid material is put in the pouch from the opened upside, the pouch inflates with an eye-shaped lateral section due to the weight of the fluid material itself, with unfolding of the doubled bottom sheet. After charging the fluid material, the upside is heat-sealed to form a top seal portion to complete a standing pouch package.

A problem of the standing pouch is the occurrence of overflow of the charged fluid material, particularly in the case of a liquid material, which occurs during opening the top seal portion.

Another problem of the standing pouch is in its usability. From its structure, conventional standing pouches permit transfer of their contents to conventional packages. When they are used as containers for use, an upper corner is cut off and used as the pourer. However, in the case of the pourer thus formed, the discharged amount tends to vary, and drooling tends to occur.

SUMMARY OF THE INVENTION

An object of the invention is to provide a standing pouch capable of ensuring transfer of a fluid material contained therein to another container without the occurrence of overflowing.

Another object of the invention is to provide a standing pouch capable of using a container for use as it is wherein the variation of the discharged amount is small and less dripping occurs.

Another object of the invention is to provide a standing pouch capable of ensuring positioning of its pourer so as to pour a fluid material contained in the pouch in a separate container without missing the opening of the container.

Another object of the invention is to provide a standing pouch capable of simplifying the process for forming a notch which functions as a starting point of tearing.

The invention provides a standing pouch which has achieved the above objects, and comprises a recess formed on the upper part of a side of the body of the pouch spaced from the upper side of the body, and a relief connecting with the inside of the pouch surrounded by an end of the upper side, the upper part of the side and the upper side of the recess and becoming a spout by removing the end portion of the relief, and which preferably further comprises an engaging portion which is engaged with an opening of a container to which fluid material contained in the pouch is transferred is formed in the recess.

DESCRIPTION OF THE PREFERRED EMBODIMENTS

The shape of the recess may be of any form capable of forming the relief, and each includes a part of circle, ellipsoid, polygon, e.g. corner, triangle, square, pentagon, hexagon, octagon, combination of curve(s) and straight line(s), etc. Examples of the part of circle are one fourth circle, half circle and three fourth circle.

Although the relief may be opened by a scissors, it is preferable to provide a means for facilitating opening on the upper part of the recess.

One means for facilitating opening is an I-shaped notch provided on the upper part of the recess. The I-shaped notch has no problem concerning to facilitate opening, but a punching blade for forming I-shaped notch cannot be loaded on a die for punching to remove the cut portion. That is, when the punching blade is loaded on the die, it is necessary to embed a single blade in the die. However, the single blade is fragile, and cannot be used for a long period different from the die. Thereupon, the I-shaped notch is formed by a punching blade separate from the die, after punching to remove the cut portion. As a result, the number of steps necessary in the process increases.

Another means for facilitating opening is a corner for tearing provided on the upside or upper part of the back of the recess. The angle ($\theta$) of the recess 16*a* is $0<\theta\leqq 130$ degrees preferably 30 to 120 degrees, and more preferably 30 to 60 degrees. When the angle is zero, the punching blade becomes a single blade, and a problem occurs in terms of the durability of the blade embedded in a die. On the other hand, when the angle exceeds 130 degrees, its functioning as the starting point of tearing becomes insufficient.

Various configurations can be taken of the corner. For example, the corner can be formed by the upper side of the recess formed laterally and the back side of the recess formed downward from the inside end of the upside. The embodiments illustrated in FIGS. 4, 6–9 and 11 are of this type. In this type of configurations, the blades for punching the upside and the back of the recess functions also as the blades for punching the corner. As a result, preparation of the die is facilitated, and the durability of the die is increased.

Figure 5:
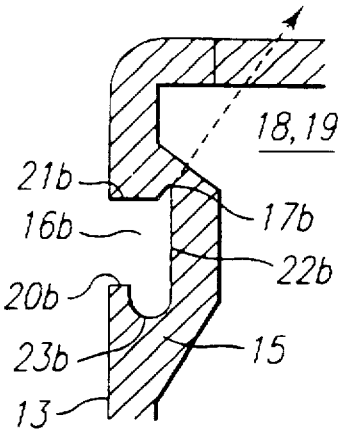

The corner can also be formed by cutting a part of the upper portion of the recess with a V-shape to form the corner. The embodiment of FIG. 5 is of this type. In this type of configuration, a corner having a preferable acute angle can be formed irrespective of the angle between the upper portion and the back of the recess.

Figure 10:
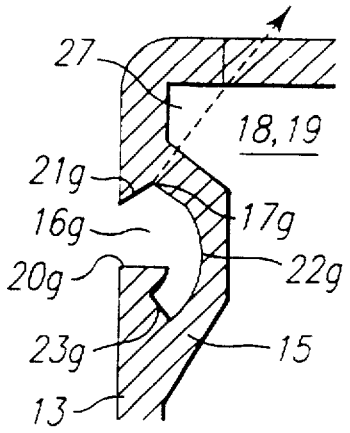

The corner can also be formed by the upper portion of the recess having a corner 100. The embodiment of FIG. 10 illustrates this type. In this type of configurations, the angle of the corner can be set apart from the angle between the upside and the back of the recess, and a plurality of the corners can be formed by the upper portion the forming a polygonal shaped line.

The engaging portion is engaged with an opening of a container to which a fluid material contained in the pouch is transferred. The engaging portion is used at the time of transferring. That is, in the standing pouch of the invention, the engaging portion 10 acts operatively together with the spout formed by removing the end portion of the relief. The opening of the container to which the fluid material is transferred may serve as the spout of the container.

The shape of the engaging portion may be any form capable of being engaged with an opening of a container to which the fluid material is transferred. The engaging portion can be roughly divided into two groups. In one group, the engaging portion is formed by a side end of the pouch and the underside of the recess of which a part or the entire underside is recessed downward. In this group, the engaging portion usually is in the form of a hook. The embodiments of FIGS. 4–10 belong to this group. In the other group, the engaging portion is formed by the upper part and the lower part of the back of the recess. In this group, the engaging portion projects from the back. The embodiments of FIGS. 11 and 12 belong to this group.

Various configurations can be used for the engaging portion. For example, the engaging portion can be formed by a side end of the pouch and the underside of the recess of which a part or the entire portion is recessed in the form of an arc. The embodiments of FIGS. 4–6 and 9 are of this type. In this type of configurations, the engaging portion is engaged with an opening of the container from the outside of the opening, and the direction of the spout of the pouch is stabilized by utilizing the engaged part as the support point upon tilting the pouch. Moreover, since the underside of the recess is recessed in an arc, the fluid material in the pouch can be transferred without contacting the underside of the recess with the end of the opening of the container.

Figure 7:
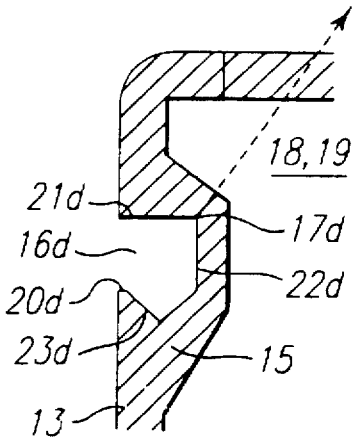
Figure 8:
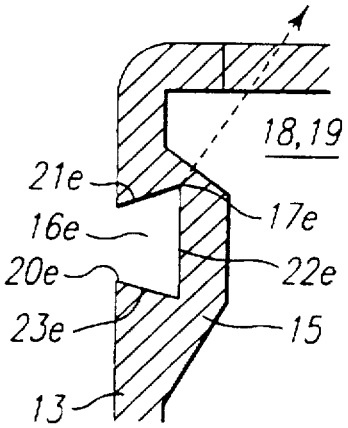

The engaging portion can also be formed by a side end of the pouch and the underside of the recess of which a part or the entire portion is recessed in the form of an angular recession. The embodiments of FIGS. 7, 8 and 10 are of a this type. In this type of configuration, the engaging portion is also engaged with an opening of the container from the outside of the opening, and the direction of the pourer of the pouch is stabilized by utilizing the engaged part as the support point upon tilting the pouch. Moreover, since the underside of the recess is angularly recessed, the fluid material in the pouch can be transferred without contacting the underside of the recess with the end of the opening of the container. The punching die can be prepared only by a combination of straight blades.

Figure 9:
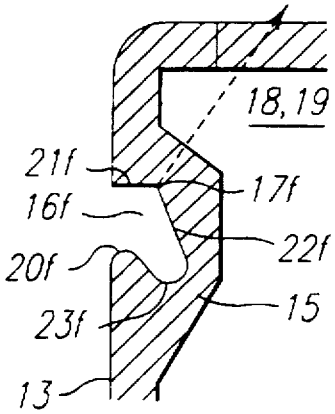

Among the above embodiments, in the engaging portion of which the projected corner(s) is rounded, such as illustrated in FIG. 9, the engaging part can move smoothly with tilting the pouch, and the transfer of the fluid material can be achieved smoothly.

In the engaging portion which is in a form of claw, such as illustrated in FIG. 10, the engaging portion engages the end of the opening of the container surely so as not to detach from the opening upon transferring the fluid material.

Figure 11:
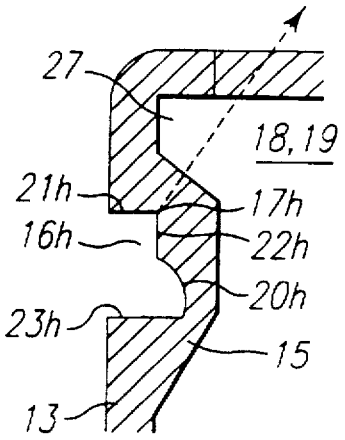
Figure 12:
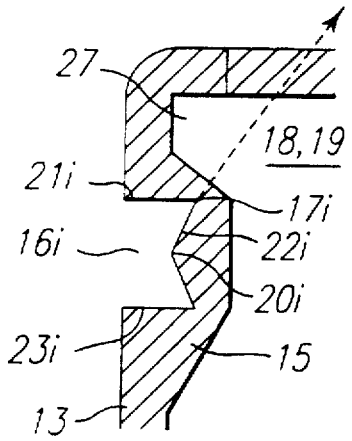

In the engaging portion formed by the upper part and the lower part of the back of the recess as shown in FIGS. 11 and 12, the engaging portion is engaged with an opening of the container from the inside of the opening, and the end of the opening of the container can touch the lower part of the back of the recess under the projected end. Thus, the transfer of the fluid material can be carried out by tilting the pouch by sliding the touched part.

Concerning respective cases in the engaging portion formed by the upper part of the back of the recess which vertically descends and the lower part which is recessed in an arc, as shown in FIG. 11, the engaging portion is engaged with an opening of the container from the inside of the opening, and the end of the opening catches the lower part in arc of the back. The pouch is tilted with sliding the end of the opening along the arc portion to transfer the fluid material contained therein to the container.

In the engaging portion formed by the upper part of the back which obliquely descends towards the outside and the lower part which obliquely ascends towards the outside, as shown in FIG. 12, the engaging portion is engaged with an opening of the container from the inside of the opening, and the end of the opening catches two positions, i.e. the oblique lower part and the underside of the recess. The pouch is tilted with sliding the end of the opening on both of the oblique lower part and the underside to transfer the fluid material contained therein to the container. The pouching die for the recess can be prepared by a combination of four straight blades, and can be used for a long period.

As mentioned heretofore, there are various configurations of the corner for tearing and the engaging portion, the engaging portion has a form capable of being engaged with the end of an opening of a container to which a fluid material container therein is transferred, and the corner for tearing can be formed by one punching process together with the engaging portion. It is preferable that the engaging portion which is engaged from the inside of an opening of a container is located nearer the spout than the engaging portion which is engaged from the outside.

The recess is formed on the upper part of either or both sides of the body of the pouch with a space from the upside of the body. As a result, when the upper end of the body of the pouch is heat-sealed, a relief connecting with the inside of the pouch is formed surrounded by an end of the upper side, the upper part of the side and the upper side of the recess.

Upon use or transfer of the fluid material contained in the pouch, the end portion of the relief is removed by tearing from the I-shaped notch or the corner for tearing by hand, and the opened relief functions as a spout.

The sheet for forming the pouch may be single layer film or laminated film. The material of the sheet can be selected from various synthetic resins, such as polyethylene, polypropylene, and the like. In the case of laminated film, paper, aluminum foil or other synthetic resin film can be laminated to polyethylene film, polypropylene film or the like. In order to improve holdability by the engaging portion, the engaging portion may be strengthened by laminating other material.

EXAMPLES

Example 1

Figure 1:
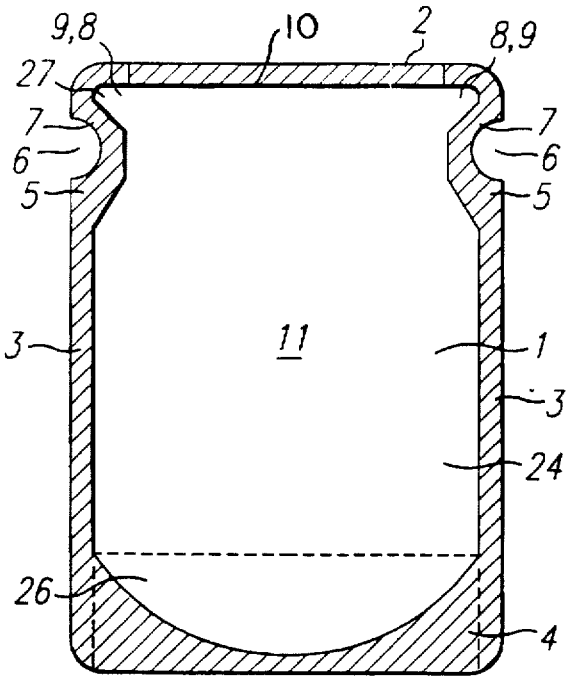
FIG. 1 is a front view of a standing pouch embodying the invention.
Figure 2:
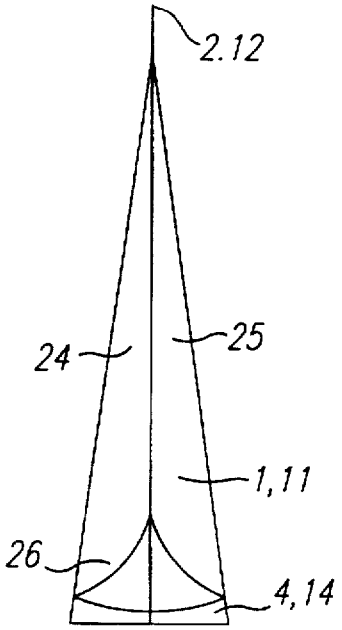
FIG. 2 is a side view thereof.

The standing pouch of Example 1 is illustrated in FIGS. 1 and 2.

The standing pouch is formed of a front sheet 24, a rear sheet 25 and a bottom sheet 26, and each sheet 24, 25, 26 is a three layer laminated film consisting of polyethylene resin film, aluminum foil and polyethylene resin film. The front sheet 24 and the rear sheet 25 are symmetrical to each other. The bottom sheet 26 is rectangle with round corners having the same width as the front and rear sheets 24, 25, and doubled. These sheets 24, 25, 26 are superposed in the order of the rear sheet 25, the doubled bottom sheet 26 being positioned on the bottom and the front sheet 24.

In this state, first, the bottom sheet 26 is heat-sealed with each of the front sheet 24 and the rear sheet 25 being in the form of an arc widened toward both sides to form bottom seal portion 4, leaving the inside faces of the bottom sheet 26 facing each other formed by the doubling without being heat-sealed. Subsequently, both sides of the front sheet 24 is heat-sealed to the rear sheet 25 along the whole length and along a predetermined width including the sides of the bottom sheet 26 facing each other to form side seal portions 3, 3. The side seal portions 3, 3 include a pair of trapezoidal widened parts 5 formed symmetrically on the upper part of both sides slightly apart from the upper end, and a half circle recess 6 is formed by a punching die to cut the widened part 5 leaving almost equal width of the heat-sealed part. Then, an I-shaped notch 7 which does not reach the inside of the pouch is formed on the upper side of the recess 6 by punching using a single blade. A fluid material is charged from the opened upper side 2 of the pouch body 1. The pouch body 1 inflates with an eye-shaped lateral section by the weight of the fluid material itself, with unfolding of the doubled portion of the bottom sheet 26. After charging the fluid material, the upper side is heat-sealed along a predetermined width to form a upper end seal portion 2. By the heat-sealing, two reliefs 8, 8 are formed at both upper corner portions surrounded by an end of the upper end 2, the upper part of the side and the upper side of the recess 6. Each relief 8 is connected to the inside of the pouch.

Upon use or transfer the fluid material, the end portion 27 is removed by tearing upward from the I-shaped notch 7 to form a spout 9. Through tearing, since no part other than heat-sealed portions is touched, the fluid material contained therein does not overflow.

Example 2

Figure 3:
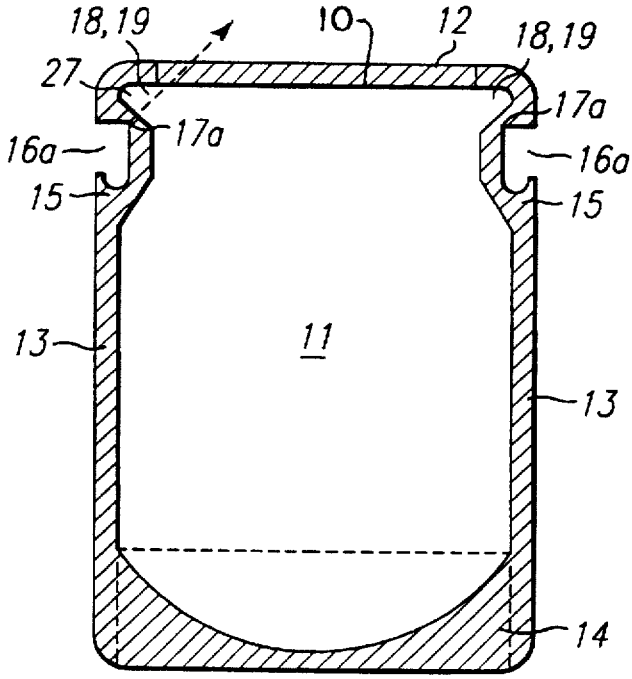
FIG. 3 is a front view of another standing pouch which is provided with an engaging portion which also embodies the invention.
Figure 4:
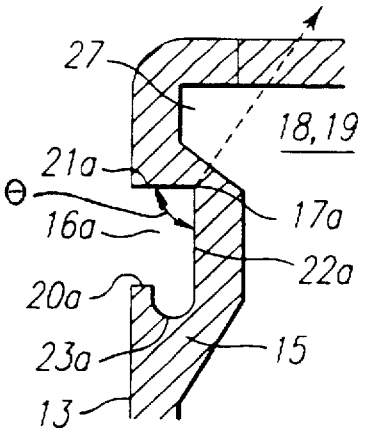
FIGS. 4 through 12 are enlarged partial front view of an upper corner of standing pouches which are provided with a corner for tearing and an engaging portion for engaging an opening of another container which also embody the invention.

Another standing pouch which is an example of the invention is illustrated in FIGS. 2–4. The standing pouch is the same as except for the widened part 15.

In this example the recess **16*a* is formed by the upper side 21*a* extending laterally and straight toward the inside, the back 22*a* of the recess descending vertically and straight from the inside end of the upper side 21*a*, and the underside 23*a* is recessed in the form of a half circle from the lower end of the back 22*a* and then extends laterally straight toward the outside so as to reach the side end of the pouch body 11. The corner 17*a* for tearing is formed by the upper side 21*a* and the back 22*a*, and the engaging portion 20*a* is formed by the recessed portion of the underside 23*a* in a half circle and the side end of the pouch body 11**.

No I-shaped notch is formed, and the spout 19 is formed by tearing an upper corner portion 27 of the relief 18 in the direction shown by an arrow in FIG. 4.

Examples 3–10

Some modifications of the recess in Example 2 are illustrated in FIGS. 5 through 12.

In Example 3 illustrated in FIG. 5, the corner is cut so as to be V-shaped to form the corner **17*b***. The other part is the same as Example 2.

Figure 6:
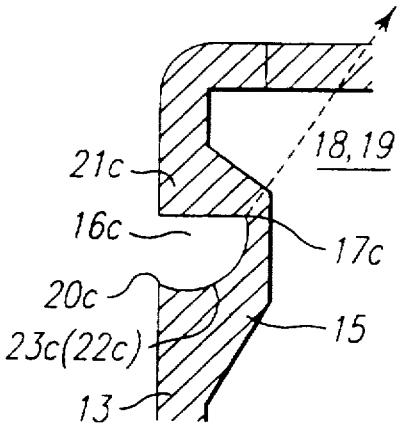

In Example 4 illustrated in FIG. 6, the recess **16*c* is formed by cutting laterally straight toward the inside to form the upper side 21*c* and then cutting an arc descending from the inside end of the upper side 21*c* and then slightly ascending to reach the side end of the pouch body. The corner 17*c* for tearing is formed by the upper side 21*c* and the upper end of the arc, and the engaging portion 20*c*** is formed by the other end of the arc which slightly ascends to the side of the pouch body.

In Example 5 illustrated in FIG. 7, the underside **23*d* is recessed by cutting into V-shaped. The other part is the same as Example 2. The corner 17*d* for tearing is formed by the upper side 21*d* and the back 22*d* of the recess, and the engaging portion 20*d*** is formed by one side of the V-shaped portion and the side of the pouch body.

In Example 6 illustrated in FIG. 8, the recess **16*e* is formed by cutting laterally slightly upward straight toward the inside to form the upper side 21*e*, cutting vertically straight from the inside end of the upper side 21*e* to form the back 22*e* of the recess, and then cutting laterally slightly upward and straight to form the underside 23*e*. Thus, the shape of the recess 16*e* is trapezoidal. The corner 17*e* for tearing is formed by the upper side 21*e* and the back 22*e*, and the engaging portion 20*e* is formed by the underside 23*e*** and the side of the pouch body.

In Example 7 illustrated in FIG. 9, the recess **16*f* is formed by cutting laterally and straight to form the upper side 21*f*, cutting vertically inward in straight to form the back 22*f*, and then cutting laterally in an S-shaped manner to form the underside 23*f* so as to project to the outer part. The corner 17*f* for tearing is formed by the upside 21*f* and the back 22*f*, and the engaging portion 20*f* is formed by the projected outer part of the underside 23*f***.

In Example 8 illustrated in FIG. 10, the recess **16*g* is formed by cutting laterally upward and straight then turning downward and straight to form the upper side 21*g*, cutting vertically an arc to form the back 22*g*, and then further cutting an arc, turning obliquely upward and straight, turning in an arc again and then turning laterally and straight to form the underside 23*g*. The corner 17*g* is formed by turning the upper side 21*g*, and the engaging portion 20*g* is formed by the projection surrounded by the outer arc part and lateral straight part of the underside 23*g*** and the side of the pouch body.

In Example 9 illustrated in FIG. 11, the recess **16*h* is formed by cutting laterally and straight toward the inside to form the upper side 21*h*, cutting vertically and straight from the inside end of the upper side 21*h*, then turning in an arc to form the back 22*h* and then cutting laterally and straight to form the underside 23*h*. The corner 17*h* for tearing is formed by the upper side 21*h* and the back 22*h*, and the engaging portion 20*h* is formed by turning the back 22*h*** of the recess.

In Example 10 illustrated in FIG. 12, the recess **16*i* is formed by cutting laterally and straight toward the inside to form the upper side 21*i*, cutting vertically outward and straight, then turning inward and straight to form the back 22*i* and then cutting laterally and straight to form the underside 23*i*. The corner 17*i* for tearing is formed by the upper side 21*i* and the back 22*i*, and the engaging portion 20*i* is formed by turning the back 22*i***.

We claim:

1. A standing pouch comprising:

a standing pouch body having a recess portion formed on an upper part of a side of the body and spaced from a removable upper corner of the body, said body also including a spaced part front and rear sheet and a bottom seal portion interconnecting said front and rear sheet, said recess portion having an upper side forming an aperture angle θ in a range of 30° to 120° with respect to a back portion of the recess and said recess portion being surrounded by an upper widened portion of the body, said back portion of the recess portion and said upper side of the recess portion wherein a spout is formed upon removal of said removable upper corner of the body wherein the upper corner of the body includes a removable corner member which extends from an upper side corner portion of said recess portion, said corner member crossing said upper side of said recess portion and wherein said upper side corner portion includes a notch formed therein which intersects with said removable corner member and wherein an engaging portion is located at one of an underside portion of the recess and a back portion of the recess, said engaging portion being engagable with an opening of a container to which a fluid material contained in the pouch is transferrable.

2. The standing pouch of claim 1, wherein at least part of the underside portion of the recess is arch shaped.

3. The standing pouch of claim 1, wherein edge portions of the recess portion comprise a combination of interconnected straight lines.

4. The standing pouch of claim 1, wherein the engaging portion comprises a at least one of a claw-shaped and hook-shaped underside portion of the recess.

5. The standing pouch of claim 1, wherein a lower part of the back portion of the recess is arc-shaped.

6. The standing pouch of claim 1, wherein both a lower part of the back portion and the underside portion of the recess are interconnected straight lines.

7. The standing pouch of claim 1, wherein the engaging portion comprises a portion which projects from the back portion of the recess.

* * * * *